US005396318A

United States Patent [19]

Asada

[11] Patent Number: 5,396,318

[45] Date of Patent: Mar. 7, 1995

[54] FIXING DEVICE HAVING A CURL COMPENSATION CAPABILITY

[75] Inventor: Hidekazu Asada, Tokyo, Japan

[73] Assignee: NEC Corporation, Tokyo, Japan

[21] Appl. No.: 147,547

[22] Filed: Nov. 5, 1993

[30] Foreign Application Priority Data

Dec. 11, 1992 [JP] Japan ..... 4-331544

[51] Int. Cl.[6] ..... G03G 15/20

[52] U.S. Cl. ..... 355/285; 219/216; 432/60; 118/60

[58] Field of Search ..... 355/282, 285, 289, 290; 219/216, 388, 469; 432/60; 118/60; 430/99

[56] References Cited

U.S. PATENT DOCUMENTS

| | | | |
|---|---|---|---|
| 4,652,110 | 3/1987 | Sato et al. . | |
| 5,084,731 | 1/1992 | Baruch | 355/290 X |
| 5,187,527 | 2/1993 | Forlani et al. | 355/282 |
| 5,237,381 | 8/1993 | Hamada | 355/321 |
| 5,245,393 | 9/1993 | Storlie et al. | 355/290 |
| 5,258,815 | 11/1993 | Nakagawa et al. | 355/282 |

FOREIGN PATENT DOCUMENTS 227178 9/1989 Japan .

*Primary Examiner*—R. L. Moses

*Attorney, Agent, or Firm*—Sughrue, Mion, Zinn, Macpeak & Seas

[57] ABSTRACT

The present invention relates to a fixing device for use in image recording apparatuses, wherein the toner-adhering face of a sheet (100) onto which toner has been transferred is heated by a heating roller (30) to fix the toner. A pressure roller (20), pressing itself against the heating roller, assists in the heat-fixing process. In order to compensate for the curl resulting from the heat of the heating roller (30), a curl correcting roller (40) heats the back side of the sheet (100) with heat transmitted from the heat conducting part (31) of the heating roller (30) to another heat conducting part (41). This configuration dispenses with a built-in heat source which the curl correcting roller (40) would otherwise need.

7 Claims, 2 Drawing Sheets

FIXING DEVICE HAVING A CURL COMPENSATION CAPABILITY

BACKGROUND OF THE INVENTION

1. Field of the Invention

The present invention relates to a fixing device for image recording apparatuses, and more particularly to a fixing device for use in such an image recording apparatus like a printer, copying machine and facsimile apparatus capable of recording an image by thermally fixing toner on a sheet of paper.

2. Description of the Prior Art

A conventional image recording apparatus using toner fixes the toner image transferred onto a sheet of paper by using a fixing device including a heating roller and a pressure roller. In this process, the toner is fixed on the sheet by the heat from the heating roller while the sheet is under pressure between the two rollers.

However, when the sheet passes between the two rollers, as the temperature of the heating roller is higher than that of the pressure roller, the moisture of the face of the sheet in contact with the heating roller vaporizes sooner, and then the sheet tends to curl toward the heating roller. As a result, sheets are not neatly stacked on the sheet stacker, and accordingly become troublesome to handle.

A fixing device to solve this problem is disclosed in the Japanese Patent Laid Open No. 1-227178 published on Sep. 11, 1989. FIG. 1 shows a cross-sectional view of this fixing device. In FIG. 1, a sheet 100 onto which a toner image is transferred is fixed while being carried by a heating roller 61 and a pressure roller 62, and forwarded via a guide plate 70 to another heating roller 63 and a roller 64. The heating roller 63 is intended to correct the curl caused by the heat of the heating roller 61, and the curling force is cancelled by the two heating rollers 63 and 61 arranged opposite to each other with respect to the sheet. This fixing device, however, requires heat sources for both heating rollers 61 and 63, thereby consumes more electric power and accordingly is uneconomical. Therefore, this disadvantage had to be overcome.

SUMMARY OF THE INVENTION

An object of the present invention is to provide a fixing device capable of correcting the curl by efficient use of a single heat source.

According to the invention, there is provided a fixing device having a heating roller for heating a sheet, onto whose surface toner has been transferred by an image recording apparatus, while heating the toner-carrying face of the sheet; pressure means pressing itself against the heating roller with the sheet intervening in-between; and a curl correcting roller, in contact with the other face than the toner-carrying face of the sheet fed from the heating roller, for heating this other face of the sheet with heat conducted through contact with part of the heating roller, wherein the heating roller and the curl correcting roller have heat conducting parts in contact with each other.

The present invention requires no particular heat source for the curl correcting roller but only a heat source for the heating roller, resulting in greater efficiency. Furthermore, since the heating roller and the curl correcting roller exchange heat through their respective heat conducting parts, the transmission of heat and motive power is made possible by providing gears in the heat conducting parts.

DETAILED DESCRIPTION OF THE PREFERRED EMBODIMENT

Figure 2:
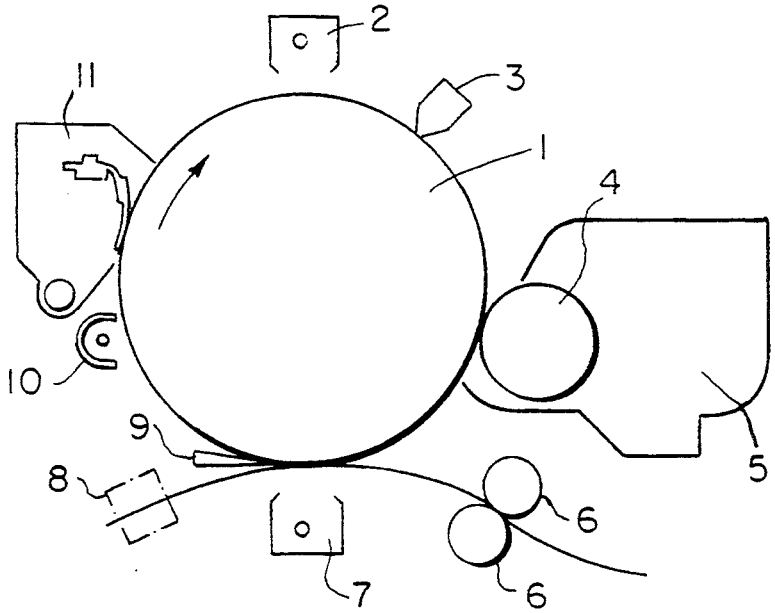
FIG. 2 schematically shows an image recording apparatus using a fixing device according to the present invention.

In FIG. 2, an image recording apparatus using a fixing device according to the present invention is exactly the same as a conventional electronic photographic apparatus except for the fixing device 8. Thus, first a charging device 2 charges a photosensitive drum 1 by evenly adhering static ions to the surface of the photosensitive drum 1, and an exposing device 3 forms a static latent image on the surface of the photosensitive drum 1. Then a toner supply device 4 adheres toner 5 to the surface of the photosensitive drum 1 according to the static latent image. On the other hand, as an ordinary sheet 100 is fed from a feed roller 6 in synchronism with the rotation of the photosensitive drum 1, the toner adhered to the surface of the photosensitive drum 1 is transferred onto the sheet 100 by a transferring device 7. The transferring device 7 transfers the toner onto the sheet 100 by applying an electric field from the back side of the sheet 10. The toner transferred to the sheet 100, after being peeled off the photosensitive drum 1 by a separating pawl 9, is fixed by the fixing device 8, which is a preferred embodiment of the present invention, and then the sheet 100 is discharged. Meanwhile, the surface of the photo-sensitive drum 1 is de-electrified by a de-electrifying device 10, and the toner remaining on its surface is removed by a cleaning device 11.

Figure 3:
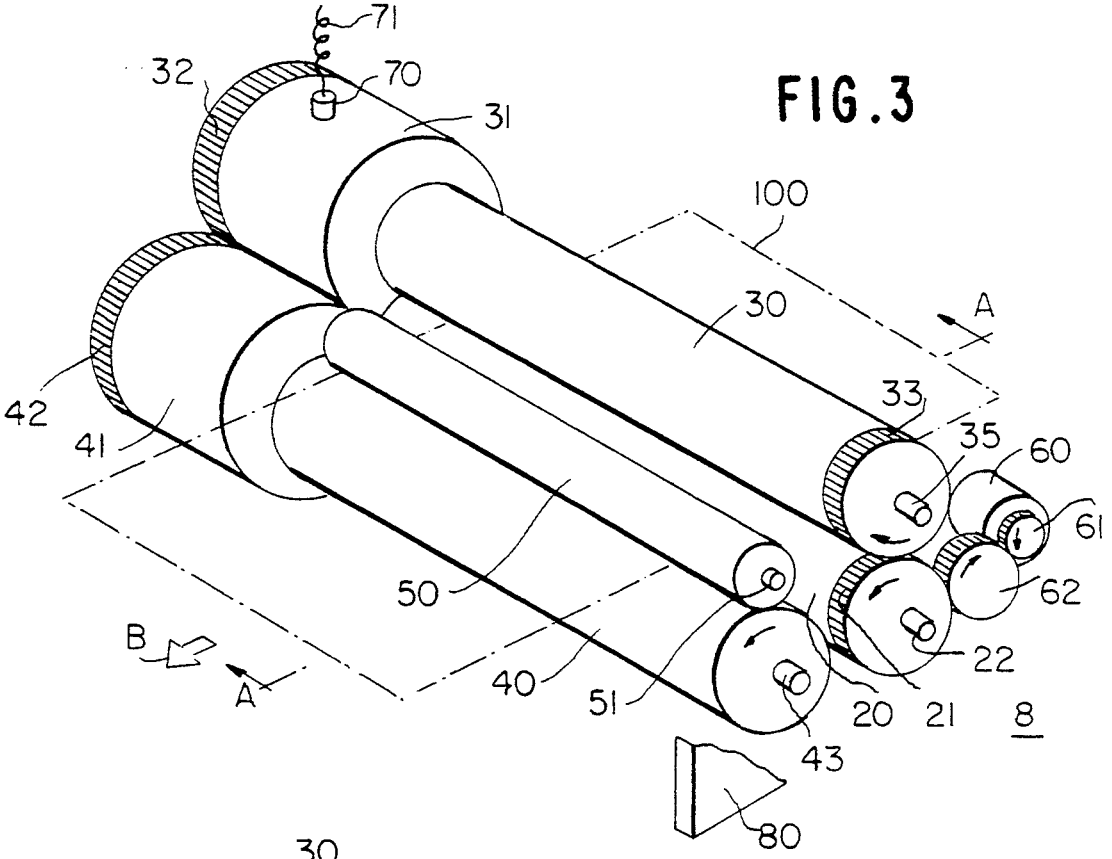
FIG. 3 is an perspective view of a preferred embodiment of the invention.
Figure 4:
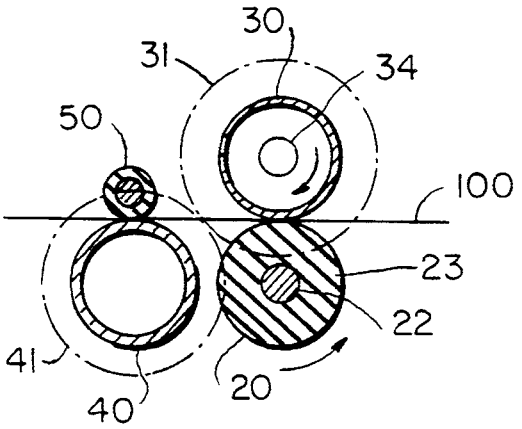
FIG. 4 is an A—A cross-sectional view of the embodiment shown in FIG. 3.

FIG. 3, which is an perspective view of the preferred embodiment of the invention, illustrates the details of the fixing device 8 of the image recording apparatus shown in FIG. 2. FIG. 4 shows an A—A cross-sectional view of the embodiment illustrated in FIG. 3.

In FIGS. 3 and 4, the fixing device 8 comprises a pressure roller 20; a heating roller 30; an aluminum roller 40, which is heated with heat transmitted from the heating roller 30, for curl correction; a rubber roller 50, which presses itself against the roller 40, as pressure means; and a motor 60, which is the motive power source.

The sheet 100, to which the transferred toner adheres, travels in the direction of arrow B, pinched between the pressure roller 20 and the heating roller 30 and between the aluminum roller 40 and the rubber roller 50. During this travel, the heating roller 30 and the rubber roller 50 are in contact with the toner-adhering face (front side) of the sheet 100, and the pressure roller 20 and the aluminum roller 40 are in contact with the back side of the sheet 100.

The pressure roller 20, as shown in FIG. 4, consists of a metal shaft 22 and a heat-resistant rubber 23 covering the shaft 22 all around so that the pressure roller 20 can be securely pressed against the heating roller 30. A gear 21 is fixed to one end of the pressure roller 20, which is rotated by the rotational force of the motor 60 via a motor gear 61 and another gear 62.

The heating roller 30 has a halogen lamp 34 located on its center shaft, and the heat radiated from this halogen lamp 34 heats the heating roller 30 to about 180° C. The heating roller 30 has at one end a heat conducting part 31, whose diameter is greater than that of the roller part, and at the other end a gear 33 which engages with the gear 21 of the pressure roller 20. The heat conducting section 31 is an essential part for transmitting heat to the aluminum roller 40.

Figure 5:
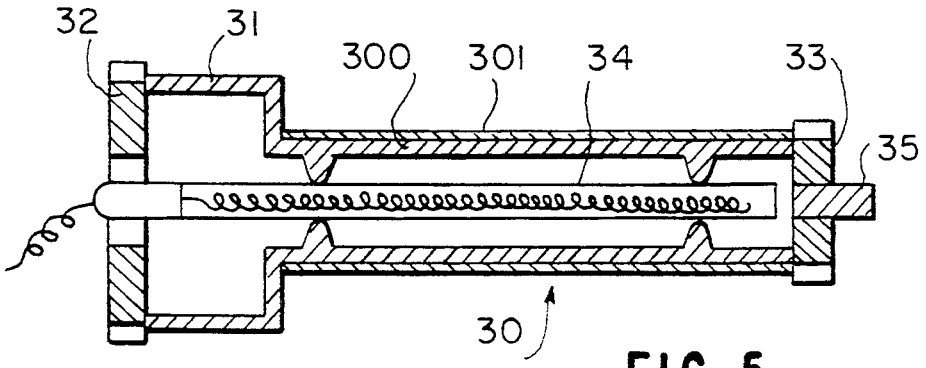
FIG. 5 is a cross-sectional view of the heating roller for use in the fixing device of FIG. 3.

As illustrated in FIG. 5, the heating roller 30 is structured by coating the surface of an aluminum tube 300 with a polytetrafluoroethylene film 301 of about 10 microns in thickness, but the heat conducting part 31 is not coated with the polytetrafluoroethylene film 301 to improve its heat conductivity. Therefore, the aluminum tube 300 is exposed in the heat conducting part 31, and its surface is smoothened. The polytetrafluoroethylene film 301 is provided to prevent the toner on the sheet from adhering to the surface of the roller 30 during its fixing process, and this film may consist of any other material than polytetrafluoroethylene only if it does not readily permit the adhesion of toner. A gear 32, fixed to one end of the heat conducting part 31, is made of a highly heat-conductive material, and its diameter is substantially equal to that of the heat conducting part 31. A preferable material for it is light aluminum, similar to that for the roller itself.

The aluminum roller 40 has at its one end a heat conducting part 41, and is rotated by the engagement of a gear 42, fitted to one of the heat conducting part 41, with the gear 32. The heat conducting part 41 receives the heat of the heating roller 30 by contacting with the heat conducting part 31. In this process, the gears 32 and 42 also contribute to the transmission of heat. The roller 40 is wholly, including its heat conducting part 41, is built of aluminum, and heated to about 100° C. with heat transmitted from the heating roller 30.

The rubber roller 50 rotates while pressing itself against the surface of the aluminum roller 40 under pressure, having in-between the sheet 100 on which the toner image has been fixed, and thereby assists in the forwarding of the sheet 100.

The heat of the heating roller 30 is detected by a sensor 70 which is in contact with the surface of the heat conducting section 31, and the calorific value of the halogen lamp 34 is controlled according to the output of that detection. The sensor 70 is pressed against the heat conducting part 31 by a spring 71, and the coupling of its output to a temperature control circuit (not shown) of known configuration causes the calorific value of the halogen lamp 34 to be controlled.

The roller shafts 22, 35, 43 and 51 of the respective rollers are supported by a side plate 80 via bearings (not shown).

As described above, the curl of the sheet 100 resulting from the image fixing between the heating roller 34 and the pressure roller 20 is corrected by the aluminum roller 40. Since the roller 40 receives heat from the heating roller 30 via the heat conducting parts 31 and 41, which are in contact with each other, it requires no heat source of its own. Furthermore, by fitting the gears 32 and 42 of the same size to one end each of the heat conducting parts 31 and 41 and rotating them, not only the heat conducting parts 31 and 41 but also the gears 32 and 42 are enabled to contribute to heat transmission, resulting in enhanced heat transmitting efficiency.

Figure 1:
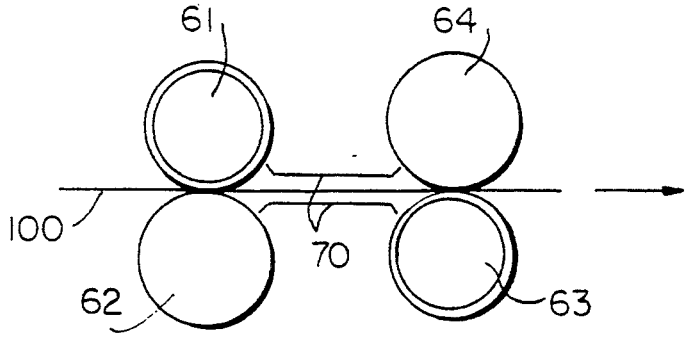
FIG. 1 PRIOR ART
FIG. 1 is a cross-sectional view of a fixing device according to the prior art capable of curl correction.

In the preferred embodiment hitherto described, a guide plate each may as well be arranged between the rollers 20 and 30 and between the rollers 40 and 50 as in the prior art fixing device illustrated in FIG. 1. The heating roller 30 and the roller 40, which, including their respective heat conducting parts 31 and 41, are built of aluminum in this embodiment, may as well be made of any other highly heat-conductive material than aluminum. Two pulleys, connected by an endless belt to transmit rotation, may be used instead of the gears 32 and 42.

The heat conducting parts 31 and 41 may be provided at both ends of the rollers 30 and 40. The gear 62 to transmit the rotational force of the motor 60 may engage with the gear 33 of the heating roller 30. In that case, the pressure roller 20 need not be a roller but a mere pressure rubber plate would suffice.

Although the present invention has been fully described by way of the preferred embodiment thereof with reference to the accompanying drawings, various changes and modifications will be apparent to those having skill in this field. Therefore, unless these changes and modifications otherwise depart from the scope of the present invention, they should be construed as included therein.

What is claimed is:

1. A fixing device for fixing toner, transferred onto a sheet of paper by an image recording apparatus, comprising:

a heating roller for feeding said sheet and heating its surface onto which toner has been transferred;

pressure means pressing itself against said heating roller with said sheet intervening in-between; and a curl correcting roller, in contact with a reverse side of the surface to which the toner has been transferred, for heating said reverse side of the surface with heat conducted through contact with part of said heating roller, wherein said heating roller and said curl correcting roller have heat conducting parts in contact with each other.

2. A fixing device, as claimed in claim 1, wherein the heat conducting parts of said heating roller and of said curl correcting roller include gears which engage with each other to transmit the heat and motive power.

3. A fixing device, as claimed in claim 1, further including a roller which is in contact with said curl correcting roller to forward said sheet.

4. A fixing device, as claimed in claim 1, wherein said heating roller has a heat source inside and the surface of said heating roller in contact with said sheet is coated with a polytetrafluoroethylene film.

5. A fixing device, as claimed in claim 4, wherein said heating roller consists of a highly heat-conductive metallic material, whose surface is coated with said polytetrafluoroethylene, and is heated with heat from said heat source, and said curl correcting roller consists of a highly heat-conductive metallic material.

6. A fixing device, as claimed in claim 5, wherein the metallic materials of said heating roller and curl correcting roller are aluminum.

7. A fixing device, as claimed in claim 1, wherein said pressure means is a rubber roller.

* * * * *